US011751662B2

(12) United States Patent
Cheng et al.

(10) Patent No.: US 11,751,662 B2
(45) Date of Patent: Sep. 12, 2023

(54) REFILLABLE MAKEUP PALETTE WITH SLIDING DRAWER MECHANISM

(71) Applicant: L'Oreal, Paris (FR)

(72) Inventors: Wenzhen Cheng, Annadale, NJ (US); Thomas Kearney, Scotch Plains, NJ (US); William Blake Soeters, Clark, NJ (US); Jesse Luis, Newport Beach, CA (US); Nikia Brown, Lake Forest, CA (US)

(73) Assignee: L'Oreal, Paris (FR)

( * ) Notice: Subject to any disclaimer, the term of this patent is extended or adjusted under 35 U.S.C. 154(b) by 196 days.

(21) Appl. No.: 17/357,705

(22) Filed: Jun. 24, 2021

(65) Prior Publication Data

US 2022/0408898 A1 Dec. 29, 2022

(51) Int. Cl.
*A45D 33/20* (2006.01)
*A45D 40/22* (2006.01)
(Continued)

(52) U.S. Cl.
CPC ..... *A45D 33/20* (2013.01); *A45D 33/006* (2013.01); *A45C 11/008* (2013.01); *A45D 40/22* (2013.01); *A45D 40/24* (2013.01)

(58) Field of Classification Search
CPC . A45C 11/008; A45C 2013/026; A45D 33/20; A45D 33/006; A45D 33/003;
(Continued)

(56) References Cited

U.S. PATENT DOCUMENTS 680,658 A * 8/1901 Hastings ..... B44D 3/04 206/1.8
1,194,187 A * 8/1916 Kendall ..... A45D 33/006 132/299
(Continued)

FOREIGN PATENT DOCUMENTS

CN 205513068 U 8/2016
CN 210329723 U 4/2020
(Continued)

OTHER PUBLICATIONS

French Search Report and Written Opinion dated Jun. 13, 2022, issued in French Application No. FR2111439, filed Oct. 27, 2021, 9 pages.
(Continued)

*Primary Examiner* — Gideon R Weinerth
(74) *Attorney, Agent, or Firm* — Christensen O'Connor Johnson Kindness PLLC

(57) ABSTRACT

A palette, such as for providing choices of a makeup includes a base enclosing a drawer. The drawer includes pans within pan compartments. The base has a drawer compartment from which the drawer can slide in and out. The pan is retained in the pan compartment by application of a force that presses on the bottom of the pan, and the top of the pan presses against a frame or lid. The pan is removable from the pan compartment when the drawer is slid out from the base to expose an opening in the pan compartment through which the pan is removed. When the drawer includes a fixed frame on top, the pan can slide out from the front of the drawer, and when the drawer includes lids on top, the pan can be removed from the top as well as the front of the drawer.

13 Claims, 8 Drawing Sheets

(51) Int. Cl.
*A45D 33/00* (2006.01)
*A45D 40/24* (2006.01)
*A45C 11/00* (2006.01)

(58) Field of Classification Search
CPC ..... A45D 33/025; A45D 40/22; A45D 40/24; A45D 40/00; A45D 40/18; A45D 2034/005; A45D 33/005; A45D 33/34; A45D 2033/001; B44D 3/125; Y10S 220/26
USPC ..... 206/581, 235, 37, 823; 220/DIG. 26
See application file for complete search history.

(56) References Cited

U.S. PATENT DOCUMENTS 1,508,649 A * 9/1924 Davis ..... A45D 33/006 132/303
1,626,613 A * 5/1927 Kendall ..... A45D 40/22 132/303
1,635,891 A * 7/1927 Kendall ..... A45D 33/006 132/293
1,664,301 A * 3/1928 Kendall ..... A45D 33/006 220/DIG. 26
1,682,534 A * 8/1928 Martinat ..... A45D 40/22 132/297
1,703,091 A * 2/1929 Bass ..... A45D 40/221 132/297
1,842,442 A * 1/1932 Butler ..... A45D 33/006 206/37
1,851,462 A * 3/1932 Steller ..... A45C 13/1084 132/294
2,031,933 A * 2/1936 Clegg ..... A45D 33/20 132/287
2,054,004 A * 9/1936 Sandberg ..... A45D 40/221 132/293
3,502,089 A * 3/1970 Paradis ..... A45D 33/20 132/294
3,637,278 A * 1/1972 Easterbrooks ..... A45D 40/22 206/823
4,421,127 A * 12/1983 Geer ..... A45D 40/22 206/823
4,526,273 A * 7/1985 Tsuji ..... A45D 40/00 206/39.6
4,538,725 A * 9/1985 Glover ..... A45D 40/22 132/294
D281,731 S * 12/1985 Phu ..... A45D 33/20 D28/83
4,589,430 A * 5/1986 Sussman ..... A45D 40/22 132/294
4,826,014 A * 5/1989 Schefer ..... A45D 33/22 206/823
4,932,547 A * 6/1990 Rodriguez ..... A45C 11/24 229/122
5,005,697 A * 4/1991 Jimbo ..... A45D 33/006 206/823
5,092,354 A * 3/1992 Pacelli, Jr. ..... A45D 40/22 206/823
5,373,862 A * 12/1994 Blachut ..... A45D 40/22 206/823
5,379,901 A * 1/1995 Blachut ..... A45D 40/22 206/823
5,655,553 A * 8/1997 Giese ..... A45D 40/22 132/303
5,813,420 A * 9/1998 Sussman ..... A45D 33/006 132/294
6,223,754 B1 5/2001 Burdi et al.
D515,244 S * 2/2006 Bae ..... D28/83
8,540,077 B2 * 9/2013 Yoshida ..... A45D 40/221 132/294
8,978,886 B2 * 3/2015 Ziemba ..... A45D 33/26 206/320
D773,735 S * 12/2016 Brogoitti ..... D28/83
11,206,909 B2 * 12/2021 Chodieva ..... A45D 40/24
11,511,563 B2 * 11/2022 Lee ..... B44D 3/02
2004/0129599 A1 * 7/2004 Yi-Hung ..... A45D 33/20 206/581
2004/0206370 A1 * 10/2004 Byun ..... A45D 33/20 132/287
2005/0205569 A1 * 9/2005 Kobayashi ..... A45D 33/006 220/4.01
2009/0320874 A1 * 12/2009 Boye ..... A45D 33/20 132/295
2010/0051048 A1 * 3/2010 Wang ..... A45D 40/24 132/294
2010/0319723 A1 * 12/2010 Parker ..... A45D 33/26 132/287
2014/0084010 A1 * 3/2014 Wan ..... A45D 33/006 220/525
2015/0201733 A1 * 7/2015 Brogoitti ..... A45D 40/18 132/288
2016/0270507 A1 * 9/2016 Thompson ..... A45D 33/006
2018/0263361 A1 * 9/2018 Langdon ..... A45D 33/20
2018/0310688 A1 * 11/2018 Lin ..... B65D 21/086
2018/0344004 A1 * 12/2018 Kim ..... H04M 1/21
2019/0008261 A1 1/2019 Olivari et al.
2019/0281950 A1 * 9/2019 Huang ..... B65D 43/20
2019/0387864 A1 * 12/2019 Hong ..... A45D 33/28
2020/0146421 A1 5/2020 Chen et al.
2021/0022480 A1 * 1/2021 Sobol ..... A45D 33/006
2022/0022623 A1 * 1/2022 Lee ..... A45D 33/008
2022/0031042 A1 * 2/2022 Sobol ..... A45D 40/22
2022/0031046 A1 * 2/2022 Sobol ..... A45D 40/22
2022/0071368 A1 * 3/2022 Sobol ..... A45D 40/24
2022/0095766 A1 * 3/2022 Li ..... A45D 33/006
2022/0265022 A1 * 8/2022 Chodieva ..... A45D 33/26
2022/0346522 A1 * 11/2022 Cheng ..... A45D 40/22

FOREIGN PATENT DOCUMENTS

JP S59-125311 U 8/1984
JP S59-130604 U 9/1984
JP H06-36509 U 5/1994
JP H07-30909 U 6/1995
JP H11-164725 A 6/1999
JP 2004-283386 A 10/2004
JP 5502598 A1 5/2014
KR 20-0474872 Y1 10/2014
KR 200474872 Y1 10/2014
WO 2018151455 A1 8/2018
WO WO 2018151455 * 8/2018 ..... A45D 33/00
WO 2012/019316 A1 2/2021

OTHER PUBLICATIONS

International Search Report and Written Opinion dated Oct. 5, 2022, issued in corresponding International Patent Application No. PCT/US2022/034905, filed Jun. 24, 2022, 13 pages.
French Search Report and Written Opinion dated Jun. 1, 2022, issued in corresponding French Application No. FR2110289, filed Sep. 9, 2021, 7 pages.

* cited by examiner

REFILLABLE MAKEUP PALETTE WITH SLIDING DRAWER MECHANISM

SUMMARY

Disclosed is a palette for a cosmetic product. A palette refers to a container to hold multiple options for a cosmetic product, usually in various shades, such as for eyeshadow, blush, and the like. The palette includes a compact lid, a compact base, and a sliding drawer. The drawer can slide in and out from the compact base. When the drawer is in the closed position, the lid can be opened and the compositions can be accessed for use from the top. When the drawer slides out of the base, individual pans can be removed and replaced with pans have other color selections.

The refillable pans can be easily accessed and removed from front or top. The sliding drawer incorporates pan-retention features. In one example, a spring tab is the main pan retention feature which presses the pan against the sliding tray top-ceiling which holds the pan in place. The upward pressure will prevent the pan movement during the merchant shipping or handling.

There are two examples to construct the drawer which is the main structure of housing the pans. In one example, the top frame of the drawer is not movable and fixed. So, the individual pans slide in the front-back direction, in order to refill/replace the pans. In another example, the top frame (i.e., lids) of the drawer is connected by a living hinge. So, when the lids are opened, the pans can be retrieved from the top. The drawer can have multiple lids connected by living hinges.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Conventionally pressed powder pans have a wide range of tolerance regarding the pan size. There are gaps between the pan and the tray which holds the powder pan. Conventional palettes fail to secure the pan, therefore, the pan will move inside of the tray during the handling and transportation, possibly resulting in damaging the pressed powder and causing breakage.

Disclosed is a palette that provides a tray with retention features to secure the individual pans to the tray to provide the extra powder/bulk protection after manufacturing, and also provides for easier removable of the pans for refilling the palette.

Spatially relative terms are used to describe features of the palette. Spatially relative terms include such terms as "front," "back," "rear," "left," "right," "center," "bottom," "top," and the like. Spatially relative terms may be used herein for ease of description to describe one feature or the feature's relationship to another feature or feature as illustrated in the figures. It will be understood that the spatially relative terms are intended to encompass different orientations of the palette other than the orientation depicted in the figures, and the spatially relative terms should be adjusted to be interpreted accordingly.

Figure 1:
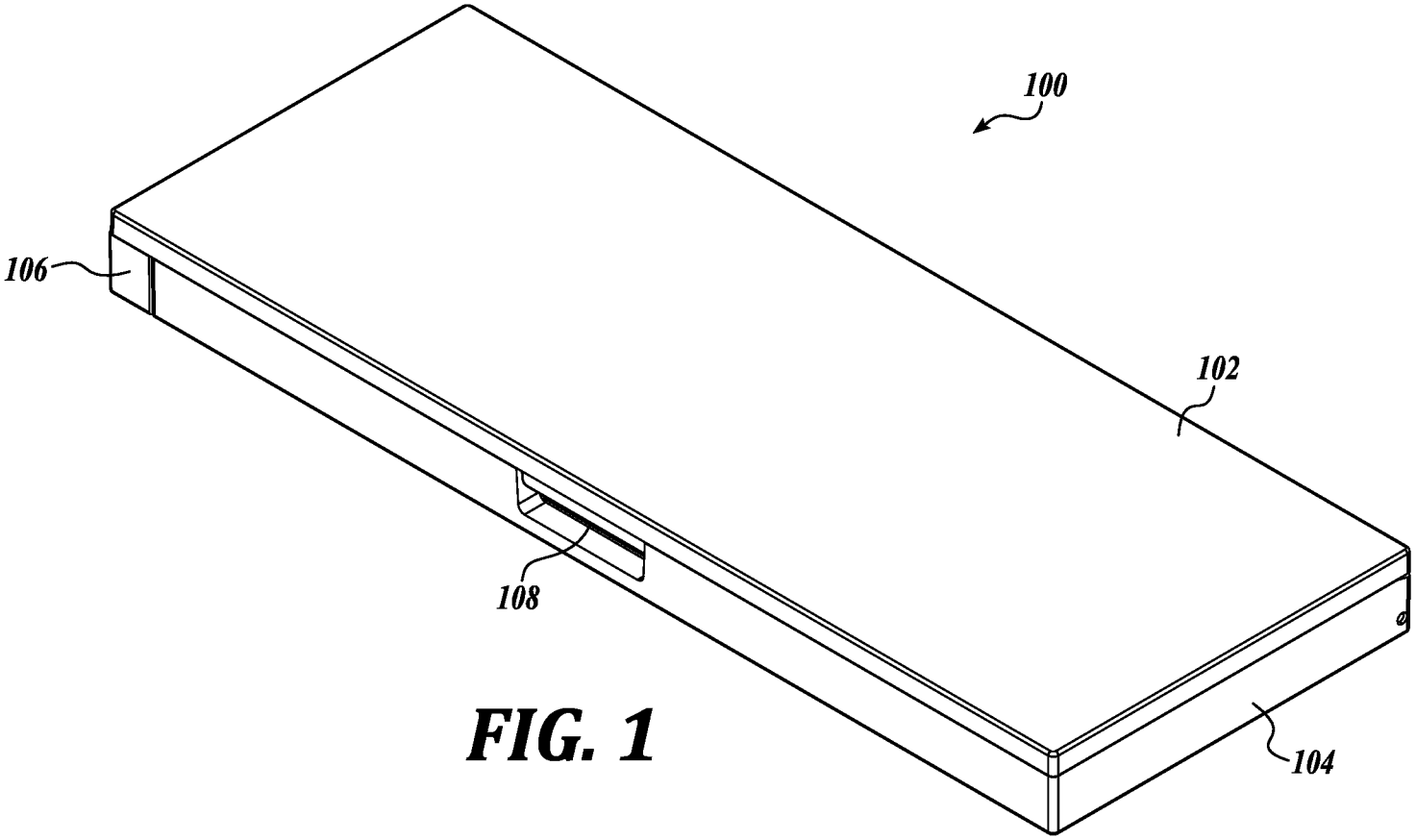
FIG. 1 is a diagrammatical illustration of a palette in accordance with one embodiment.
Figure 2:
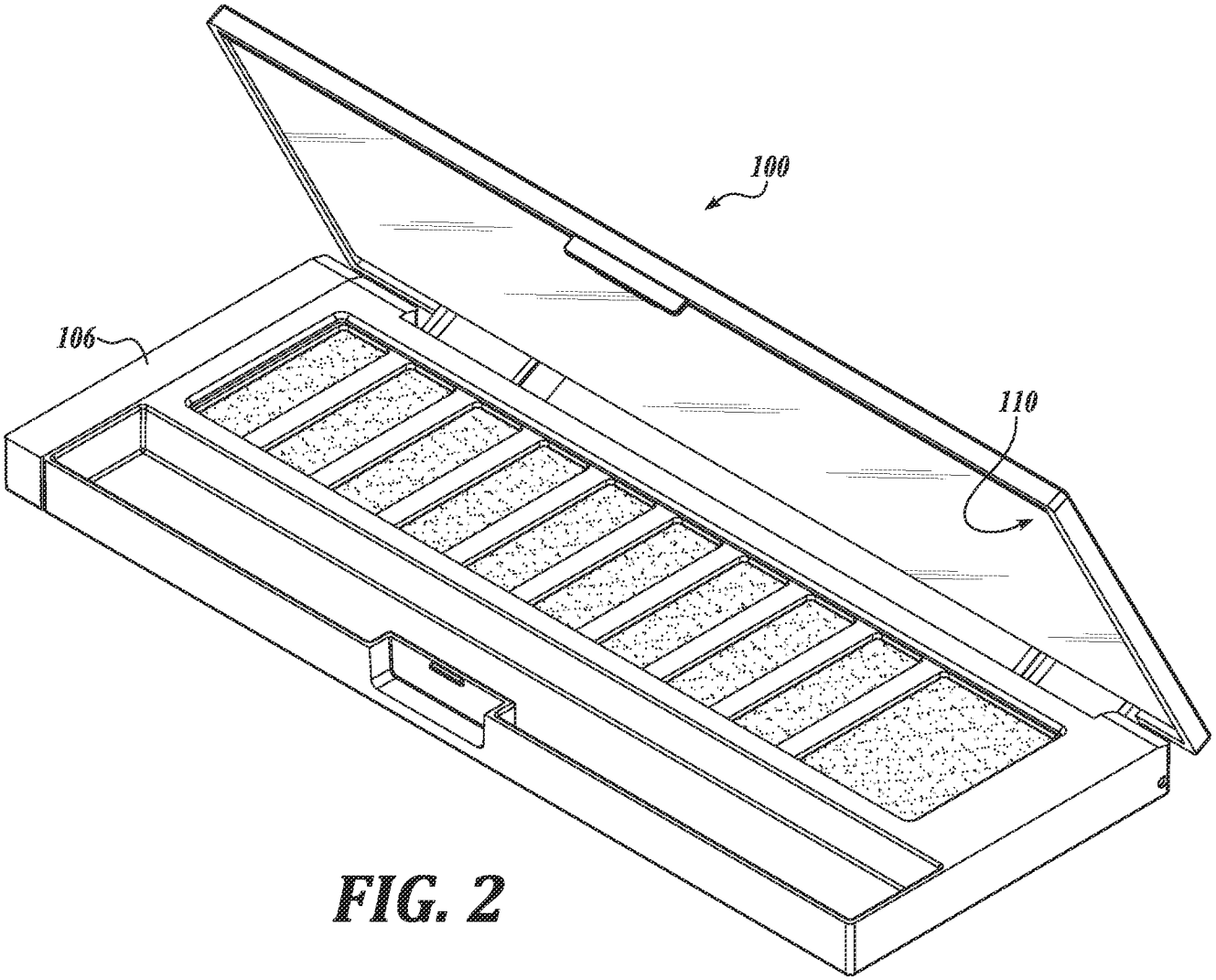
FIG. 2 is a diagrammatical illustration of the palette of FIG. 1 with the lid open to access the pans.
Figure 3:
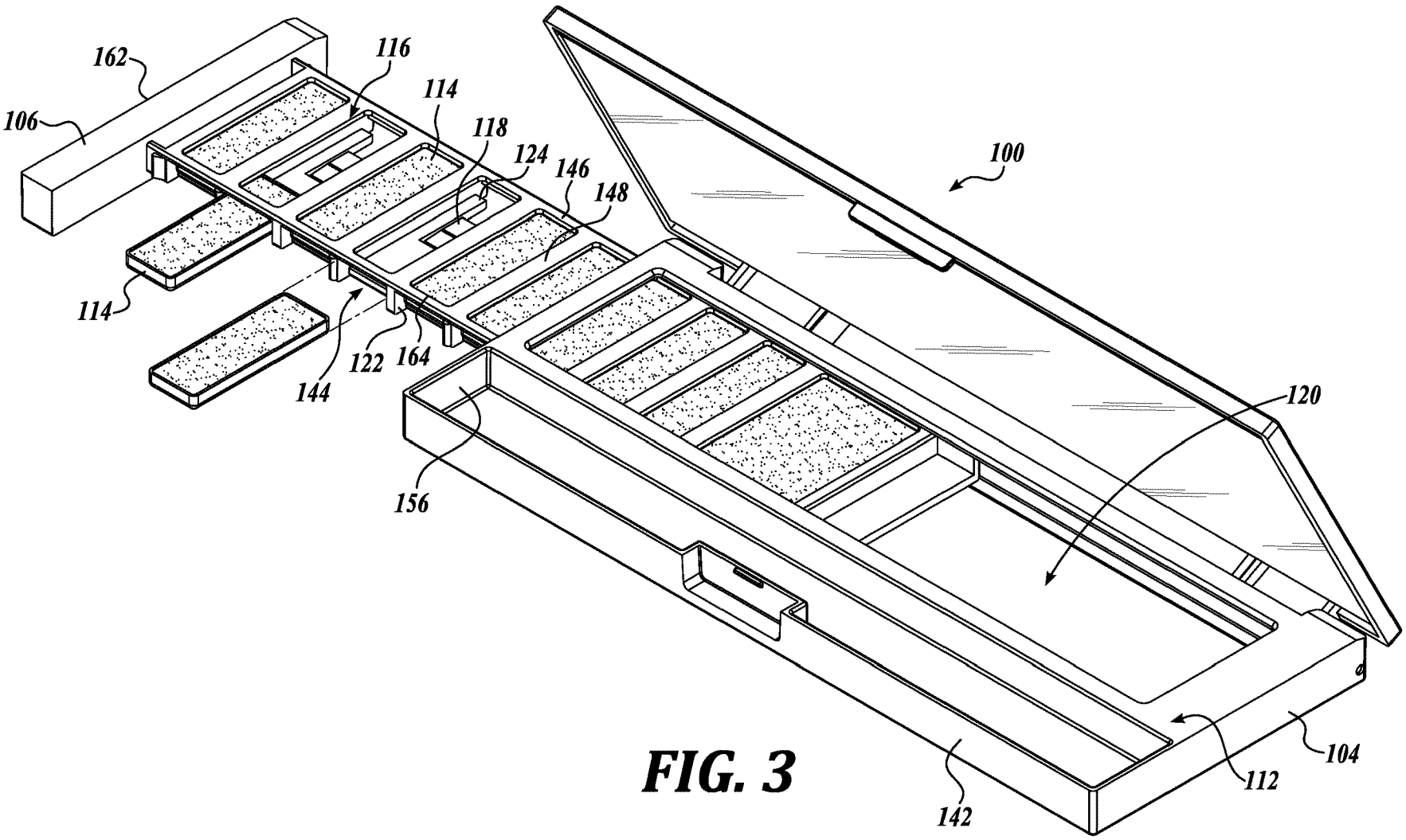
FIG. 3 is a diagrammatical illustration of the palette of FIG. 1 with one example of the drawer sliding from the side, and the pans are removable from the front.

FIGS. 1, 2 and 3 are diagrammatical illustrations of the palette 100 in accordance with one embodiment. The palette 100 includes a lid 102, a base 104 and a sliding drawer 106. The lid 102 is connected to the base 104, for example, at the back side via any hinge mechanism that allows opening the lid 102. The lid 102 is closed by the clasp 108 at the front to secure the lid 102 to the base 104 in the closed position. The palette 100 is a generally rectangular six-sided structure. Therefore, the corresponding lid 102 and base 104 are generally defined by a shape that is also rectangular and six-sided. FIG. 2 is a diagrammatical illustration of the palette 100 in the open position. The lid 102 may optionally include a mirror 110 attached to the underside of the lid 102.

As seen in FIG. 3, the drawer 106 slides in and out from one side of the base 104. The base 104 is constructed so as to form a drawer compartment 120 to accommodate the sliding drawer 106 within the base.

Figure 4:
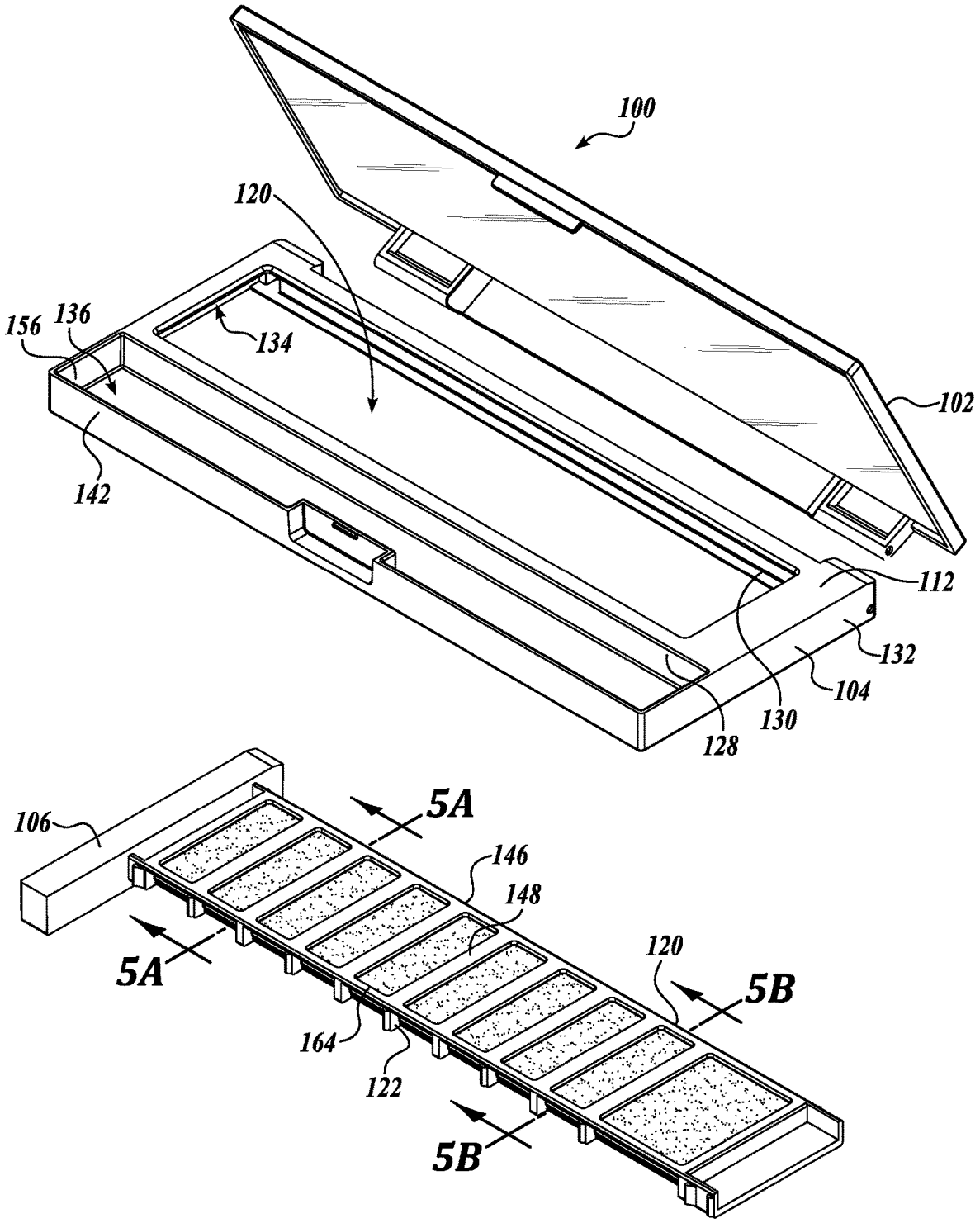
FIG. 4 is a diagrammatical illustration of the palette of FIG. 1 exploded to show individual parts.

In FIG. 4, the base 104, and more particularly the drawer compartment 120, is formed from upright walls on three of four sides. There is an upright wall 128 on the front side and an upright wall 130 on the back side making up the longer dimension of the base 104 and drawer compartment 120. There is an upright wall 132 on the right side making up the shorter dimension of the drawer compartment 120. The fourth side on the left of the base 104 has an opening 134 to allow the drawer 106 to slide in and out from the left side. The right wall 132 can be extended forward of the front wall 128 to the front wall 142 of the base 104. A partial upright wall 156 on the left side together with the extension of the right wall 132 to the front wall 142 form a tray 136 for storing brushes, pencils, and the like.

Figure 5A:
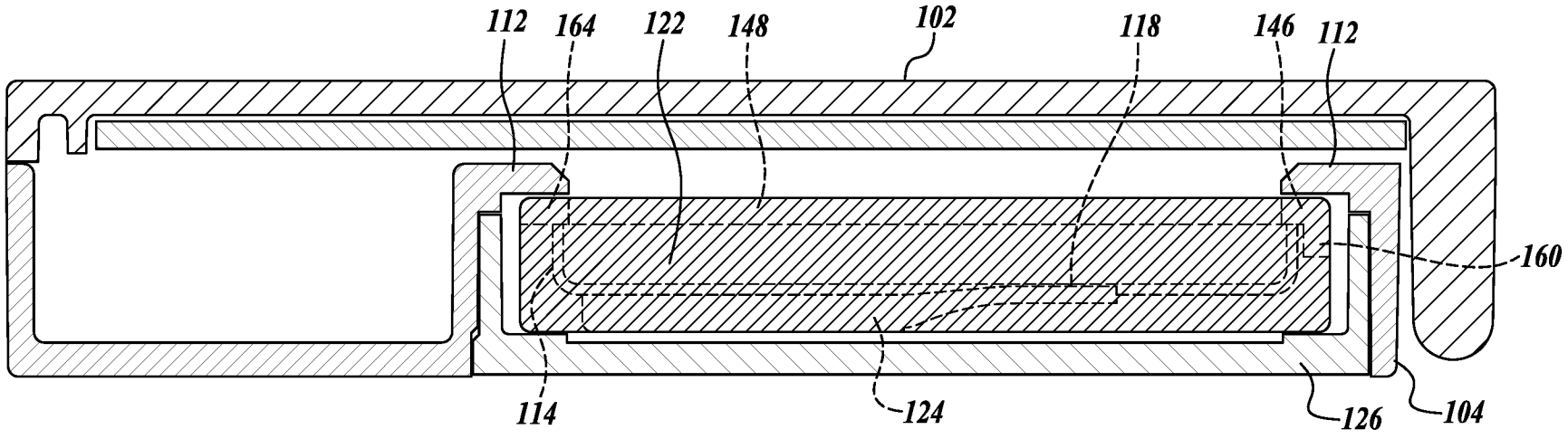
FIG. 5A is a diagrammatical illustration of a cross section of the palette of FIG. 1.
Figure 5B:
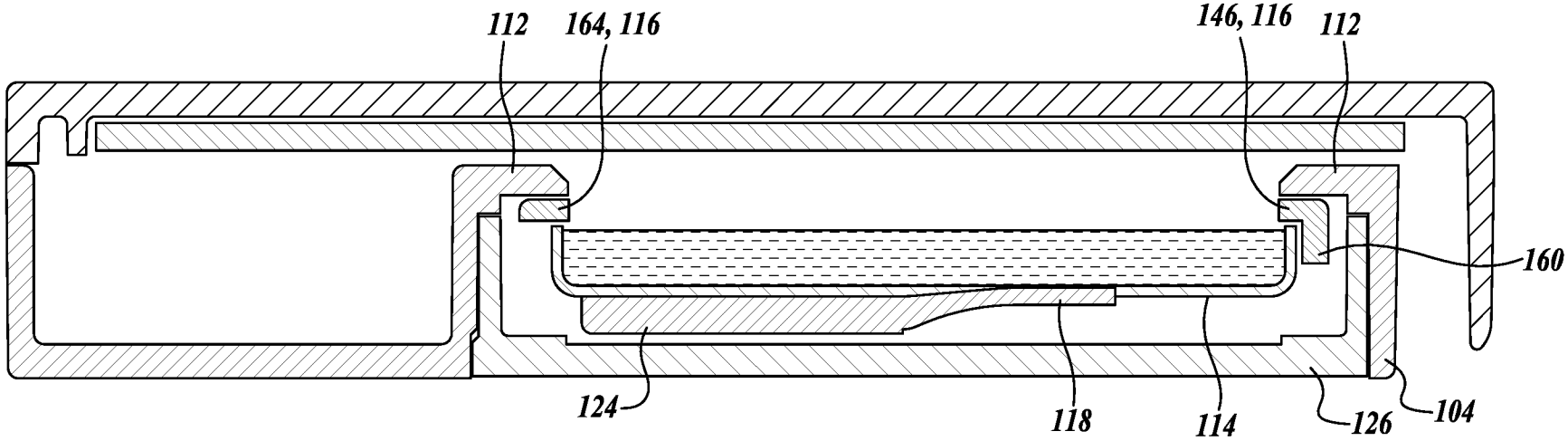
FIG. 5B is a diagrammatical illustration of a cross section of the palette of FIG. 1

The base 104 includes a bottom piece 126 that can be a separate piece or integral with the base 104 and fits into the base 104, thus forming the bottom of the base 104 and the drawer compartment 120 as best seen in FIGS. 5A and 5B.

The base 104 includes a generally horizontal upper border 112 supported by the tops of the walls 128, 130, and 132. The upper border 112 extends inward on all four sides from the walls 128, 130, and 132 and opening 134, thereby leaving an area of reveal on the underside of the border 112 against which the top of the drawer 106 can lie. Further, the inner edges of the border 112 create a rectangular opening for accessing the pans on the drawer 106 when in the closed position. The underside of the upper border 112 maintains the drawer 106 in place from moving up.

FIG. 3 is a diagrammatical illustration showing removal of the drawer 106 from the side of the base 104. The drawer 106 is constructed with a plurality of individual pan compartments 144, each pan compartment accommodating one pan 114. The size of the pan compartments 114 will be in relation to the size of the pans 114. A pan 114 is generally a six-sided structure which fits into the six-sided pan compartment 144. The pan 114 can be formed of a unitary piece of thin walled material having a bottom wall, left, right, front, and back with the top being entirely open, thereby exposing the top edges of the right, left, front, and back walls.

One example of a drawer 106 has a fixed integral upper frame 116 fixed to and forming the top side of the drawer 106. The frame 116 can be formed as a single unitary piece that is fixed horizontally on top side of the drawer 106, and the frame 116 cannot swing open. The upper frame 116 is provided with openings equal to the number of pans 114 to allow accessing each pan 114. One example of the upper frame 116 is formed by two long stringers 146, 164 extending generally parallel to each other in the long dimension. The long stringers 146, 164 are connected by a plurality of cross stringers 148 connecting the two long stringers 146, 164 at generally regular intervals. The spacing from one cross stringer 148 to an adjacent cross stringer 148 can vary based on the width of the pans 114. The area of reveal underneath the long stringers 146, 164 and cross stringers 148 of the frame 116 can be sufficient so that the tops of the pans 114 can rest against the underside of the frame 116, but, the area of reveal underneath the long stringers 146, 164 and cross stringers 148 should not be so large so that access to the pressed powder in the pans 114 is overly restricted.

The frame 116 is constructed so as to house the pans 114 in a manner that allows the pans 114 to slide out from the front side of the drawer 106 when the drawer 106 is slid open. Generally, each six-sided pan compartment 144 has the frame 116 for the top side, a back piece connected to the frame 116 that can prevent the pans 114 from sliding out of the rear of the drawer 106. A pan compartment 144 has a vertical cross member 122 for the right and left sides. The vertical cross members 122 are attached to the underside of the cross stringers 148 of the frame 116. A floor piece 124 connects one cross member 122 to the adjacent cross member 122. The floor piece 124 extends between the vertical cross members 122 in the long dimension. The floor piece 124 is located on the bottom and forms the bottom side of the pan compartment. Accordingly, the pan compartments 144 are generally elongated box-shaped compartments, the six sides of which include an opening in the front, two vertical cross members 122 forming the right and left sides, the underside of the frame 116 forming the top side, and an angled long stringer 146 forming the rear side of the pan compartment 144. An angled long stringer 146 is a piece having two long members joined together along the long edges at about 90 degrees to each other.

The floor piece 124 is connected perpendicular to the two adjacent vertical cross members 122. The floor piece 124 can be manufactured to include a spring tab 118.

The horizontal width of the cross stringers 148 of the frame 116 extends beyond the width (i.e., thickness) of the vertical cross members 122, therefore, the cross stringers 148 have an area of reveal when viewed from the underside of the frame 116. The horizontal width of the long stringers 146, 164 of the frame 116 can also have an area of reveal on the underside. Therefore, the pressed powder in the pans 114 can be accessed from the top openings in the frame 116, and the tops of the walls of the pans 114 can be hidden from view from the top by the frame 116, which also functions to retain the pans 114. The pans 114 are pressed from the bottom by the spring tabs 118 formed out of the floor pieces 124 in each pan compartment 144 thereby pushing the pans 114 against the underside of the frame 116.

Referring to FIG. 5A, the construction of the frame 116 is illustrated. A cross section is taken across vertical cross member 122. The tops of the vertical cross members 122 are seen connected to the long stringers 146, 164 and the cross stringers 148 of the frame 116. Also shown is the upper side of the frame 116, particularly the upper surfaces of the long stringers 146, 164, are located on the underside of the upper border 112 of the base 104. The rear long stringer 146 can have a angled cross section, thereby providing a back stop 160 that stops the pan 114 at the back of the pan compartment 144. The front long stringer 164 can have a rectangular cross section thereby allowing the pan 114 to slide forward only.

The spring tabs 118 can be thinned sections of the floor piece 124. The spring tabs 118 can be cut on three sides, for example, of the floor pieces 124. The spring tabs 118 are configured so that the spring tabs 118 protrude above the top surface of the floor piece 124, thereby can produce an upward biasing force on the pans 114 as the pans 114 are inserted within the pan compartments 114. The spring tabs 118 will press on the bottom side of the pans 114, and the top edges of the walls of the pans 114 can press on the undersides of the long stringers 146, 164 and also the cross stringers 148.

A handle 162 is attached to the left side of the drawer 106. The front to back dimension of the handle 162 can be similar to the front to back dimension of the base 104 and lid 102, so the handle 162 generally fills in for the left side where the base 104 has the opening 134. The handle 162 can be a rectangular shape with an opening on the bottom to allow pulling the drawer 106 out.

Referring to FIGS. 6, 7, 8A, and 8B, another example of a drawer 206 will be described. The palette illustrated in FIGS. 6, 7, 8A, and 8B uses the same lid 102, base 104, and bottom piece 126 as described with reference to FIGS. 1 to 5. Additionally, like numbers represents like parts.

Figure 6:
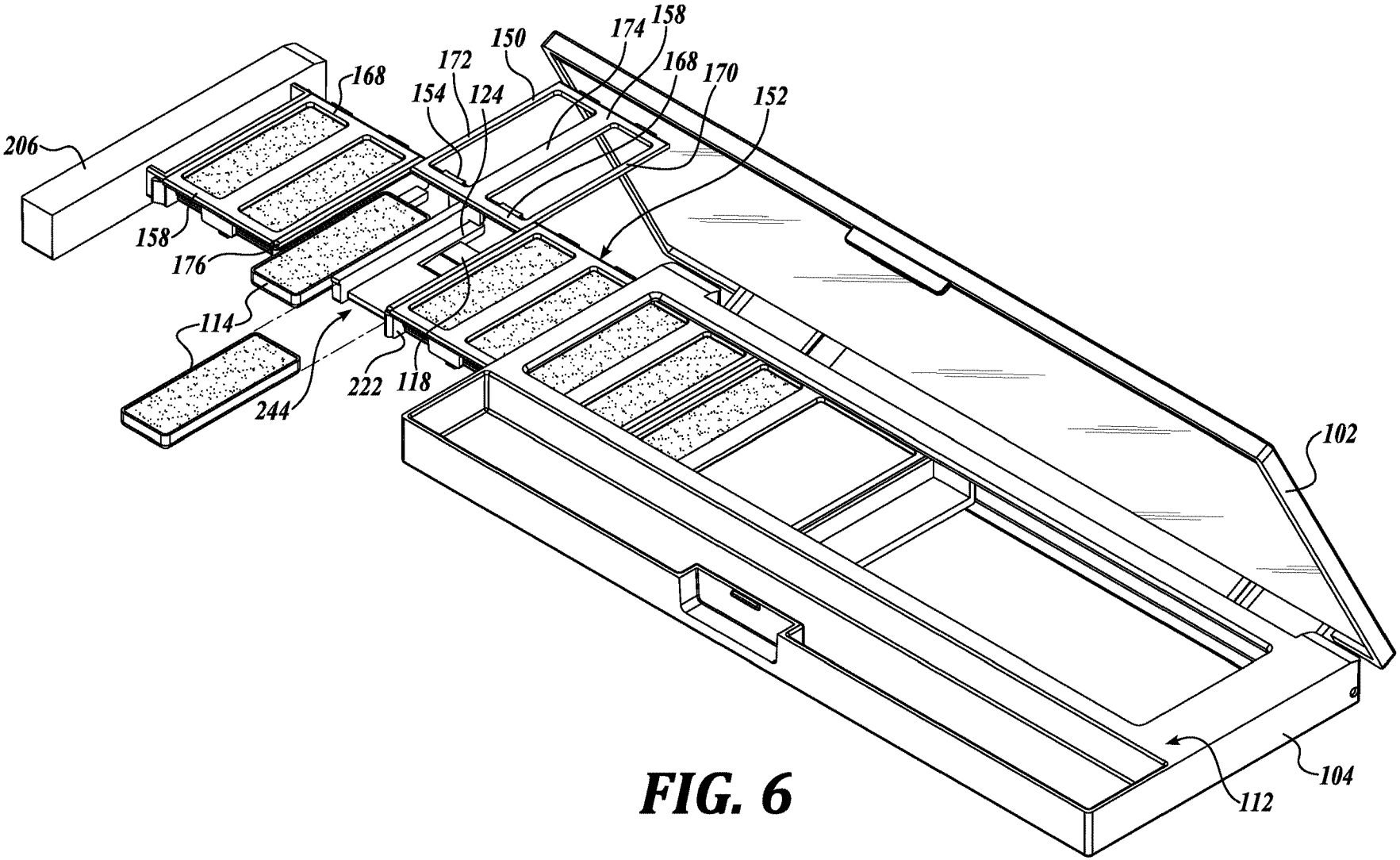
FIG. 6 is a diagrammatical illustration of the palette of FIG. 1 with a second example of the drawer sliding from the side, and the pans are removable by lifting of the pan compartment lids.

Referring to FIG. 6, the fixed integral top frame 116 of drawer 106 is replaced by one or more pan compartment lids 150 fixed to the back side the drawer 206, but are not fixed to the front side of the drawer 206, which allows the pan compartment lids 150 to swing open allowing the pans to be removed. Similar to drawer 106, the drawer 206 also has a plurality of pan compartments 244. Generally, each pan compartment 244 for a pan 114 is bordered on top by the underside of a pan compartment lid 150. Two adjacent pan compartments 244 can share a single pan compartment lid 150. However, one or more than two pan compartments 244 can share a pan compartment lid 150. It is possible for each pan compartment 244 to have its own pan compartment lid 150. It is also possible for every pan compartment 244 to be covered by a single pan compartment lid 150, which would resemble the top frame 116 described herein, except that the frame would be constructed so as to swing up on hinges. Here, the example of the pan compartment lid 150 is provided with two openings to cover two pan compartments 244.

Figure 8A:
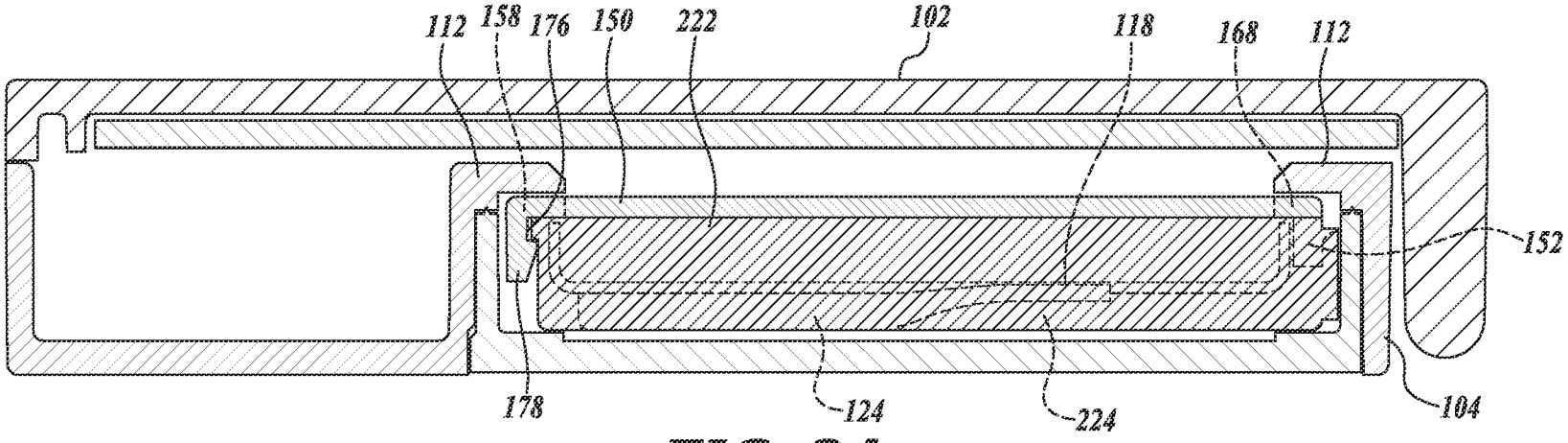
FIG. 8A is a diagrammatical illustration of a cross section of the palette of FIG. 7.
Figure 8B:
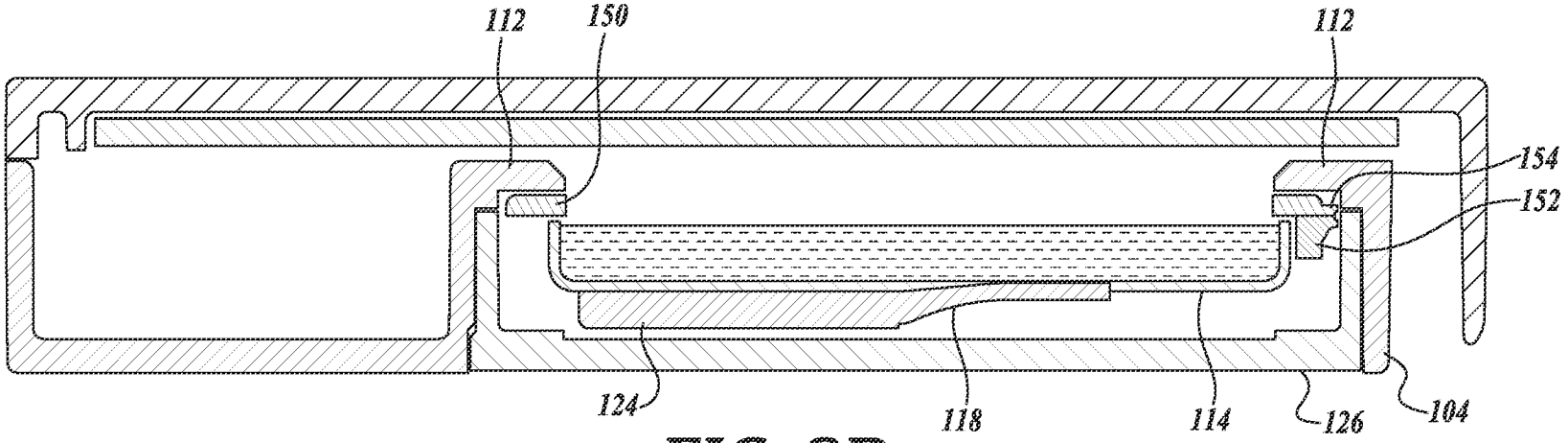
FIG. 8B is a diagrammatical illustration of a cross section of the palette of FIG. 7.

A pan compartment lid 150 is attached to a long stringer 152 extending in the long dimension at the rear of the drawer 206 (seen in FIG. 8B). The long stringer 152 at the rear side of the drawer 206 is for attaching the pan compartment lids 150 via a living hinge 154. A living hinge 154 can be a thinned flexible section of material integral to both the pan compartment lid 150 and the long stringer 152 which flexes to allow the pan compartment lid 150 to swing up but also connects the pan compartment lid 150 to the drawer 206. The long stringer 152 also acts as a back stop that can prevent the pans 114 from sliding out of the rear of the drawer 206. A pan compartment 224 is bordered on two sides by a vertical cross member 222. The floor piece 124 connects one vertical cross member 222 to the adjacent vertical cross member 222. The floor piece 124 extends between the vertical cross members 222 in the long dimension. Accordingly, the pan compartments 244 are generally elongated box-shaped compartments, the six sides of which include an opening in the front, two vertical cross members 222 forming the right and left sides, the floor piece 124 as the bottom side, the underside of the pan compartment lid 150 forming the top side, and the long stringer 152 forming the rear side of the pan compartment 244. In contrast to the pan compartment 144, the pan compartment 244 can also be opened from the top by opening the pan compartment lid 150.

The floor piece 124 is connected perpendicular to the two adjacent vertical cross members 222. The floor piece 124 can be manufactured to include the spring tab 118.

The pan compartment lids 150 replace the integral frame 116. The pan compartment lids 150 are not fixed to the vertical cross members 222, but are fixed to the rear long stringer 152 via the living hinge(s) 154, and the pan compartment lids 150 can swing up to allow a pan 114 to be removed from the front or from the top, as there is no fixed frame to prevent its removal from the top. The pan compartment lid 150 can be fixed or unfixed at the front side via a clasp. When the pan compartment lids 150 are fixed at the front, this allows pressing the tops of the pans 114 against the undersides of the pan compartment lids 150, thereby retaining the lids.

A pan compartment lid 150 has one or more openings to allow access to the pressed powder from the upper side of the pan or pans 114. An example of a pan compartment lid 150 is an unitary structure with a front member 158 and a back member 168. Both front member 158 and back member 168 extend lengthwise to the drawer compartment 120. Depending on the number of pans 114 that the pan compartment lid 150 is intended to cover, the number of cross members can vary. A pan compartment lid 150 can have a right edge cross member 170 and a left edge cross member 172. If the pan compartment lid 150 covers two pans 114, then, the pan compartment lid 150 would have a center cross member 174. The center cross member 174 coincides with the top surface of a vertical cross member 222. The horizontal width of the center cross member 174 of the pan compartment lid 150 extends beyond the width (i.e., thickness) of the vertical cross members 222, therefore, the center cross member 174 has an area of reveal when viewed from the underside of the pan compartment lid 150.

In the case of the right and the left edge cross members 170, 172, to get the same area of reveal from the bottom side, the horizontal width of the right and left edge cross members 170, 172 can be half as wide as a center cross member 174, because the right and left edge cross members 170, 172 will lie on half of the width of the vertical cross members 222. In any event, the right and left edge cross members 170, 172 can be more than half the thickness of the vertical cross members 222, because the right and left edge members 170, 172 of one pan compartment lid 150 will lie juxtaposed to the respective right or left edge member of the adjacent pan compartment lid 150. Therefore, in one example, the horizontal width of the right and left edge members 170, 172 will be more than half the thickness of the vertical cross members 222 to provide an area of reveal from underneath. The area of reveal of the right, left, and center cross members (170, 172, 174) function to retain the pans 114 from falling out of the top of the drawer 206 with the pan compartment lid 150 closed.

The vertical cross members 222 can be provided with a clasp. The clasp can include a bump 176 on the front side of the vertical cross members 222 that catches with a corresponding ramp 178 on the front member 158 of the pan compartment lid 150 as seen in FIG. 8A.

When the pan compartment lids 150 are in the closed and locked position, both the front member 158 and back member 168 also function to retainer the pans 114 within the pan compartments 244 similar to the frame 116 of the drawer 106.

Also similar to drawer 106, the drawer 206 retains the pans 114 to be accessible from the openings in the pan compartment lids 150, and the tops of the walls of the pans 114 can be hidden from view from the top. The pans 114 are pressed from the bottom against the underside of the pan compartment lids by the spring tabs 118 formed out of the floor pieces 124 in each pan compartment 244.

Referring to FIG. 8A, the construction of the pan compartment lid 150 is illustrated. A cross section is taken across vertical cross member 222. The pan compartment lid 150 rests on the top of the vertical cross member 222 in the manner described above, thus, retaining the tops of the pans 114.

Here, the vertical cross members 222 are connected to the long stringer 152 at the back, and the floor pieces 124 at the bottom connect adjacent vertical cross members 222 to add rigidity to the drawer 206.

The upper sides of the pan compartment lid 150, particularly the upper surfaces of the front member 158 and back member 168, are located on the underside of the upper border 112 of the base 104. Here, the underside of the upper border 112 can also be used to fix the pan compartment lid 150 in place, such that the clasp on the pan compartment lid 150 may be unnecessary for fixing the pan compartment lids 150 in place.

As in drawer 106, the floor pieces 124 of drawer 206 span adjacent vertical cross members 222. The spring tabs 118 can be thinned sections of the floor piece 124. The spring tabs 118 can be cut on three sides of the floor pieces 124, so that the spring tabs 118 protrude above the top surface of the floor piece 124, so that the spring tabs 118 can produce an upward biasing force on the pans 114 as the pans 114 are inserted within the pan compartments 244 and pressed down by the closing of the pan compartment lids 150. The spring tabs 118 will press on the bottom side of the pans 114, and the top edges of the walls of the pans 114 will press on the undersides of the pan compartment lids 150, particularly, on the right, left, and center cross members (170, 172, 174), and also on the front and back members (158, 168). Thereby, the pans 114 are retained by the pan compartment lids 150 when closed.

Figure 7:
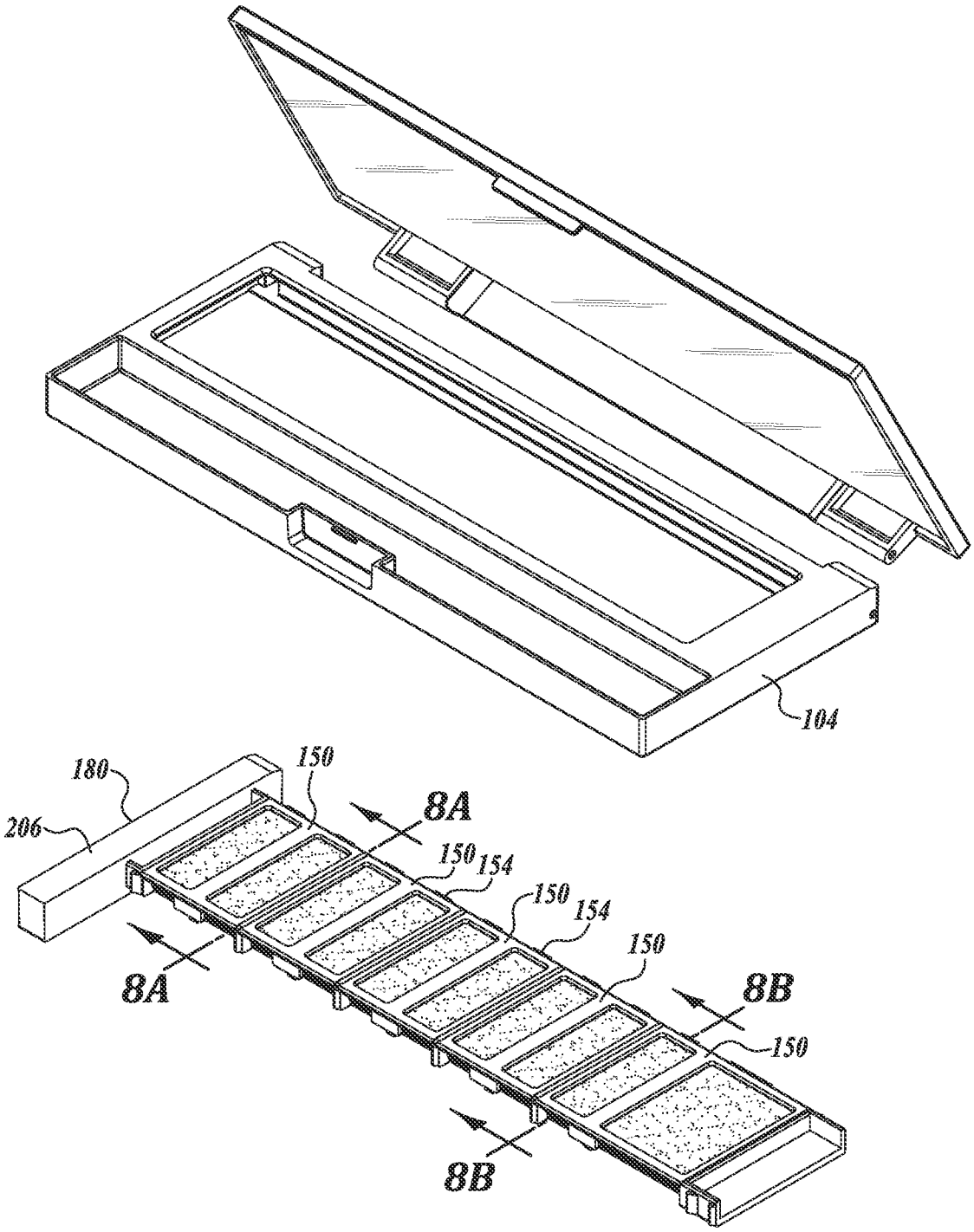
FIG. 7 is a diagrammatical illustration of the palette of FIG. 6 exploded to show individual parts.

Referring to FIG. 7, a handle 180 is attached to the left side of the drawer 206. The front to back dimension of the handle 180 can be similar to the front to back dimension of the base 104 and lid 102, so the handle 180 generally fills in for the left side where the base 104 has the opening 134. The handle 180 can be a rectangular shape with an opening on the bottom to allow pulling the drawer 206 out.

In an embodiment, a palette 100 comprises a base 104 enclosing a drawer 106, 206; the drawer includes a plurality of pans 114, each pan is within a pan compartment 144, 244, and each pan holds a composition, and the drawer can slide in and out from the base; the pan is retained in the pan compartment by application of a force that presses on a bottom of the pan, and a top of the pan presses against a frame 116 or lid 150 connected on top of the drawer; and the pan is removable from the pan compartment when the drawer is slid out from the base to expose an opening in the pan compartment 144, 244 through which the pan is removed from the drawer.

In an embodiment, the base 104 is a six-sided structure with an opening 134 on one side to allow the drawer to slide in and out.

In an embodiment, the pan compartment 144, 244 is a six-sided structure wherein at least the front of the compartment is open to allow the pan to slide in and out from the pan compartment.

In an embodiment, the drawer 106 includes a frame 116 fixed to a top side of the drawer, wherein the frame cannot swing open.

In an embodiment, the frame 116 includes two opposite long stringers 146, 164 connected to each other by cross stringers 148, and the frame has an opening for each pan compartment.

In an embodiment, a right and left vertical cross member 122 form the right and left sides of the pan compartment 144 the cross stringers 148 lie on top of the vertical cross members and an area of reveal is provided by the underside of the cross stringers.

In an embodiment, the drawer 206 includes one or more pan compartment lids 150 connected to the drawer via hinges 154, the pan compartment lids can swing open to allow the pans to be removed from the top of the drawer.

In an embodiment, the pan compartment lid 150 includes a left edge cross member 172, a right edge cross member 170, a front member 158, and a back member 168 forming at least one opening through which a pan is accessed when the lid is closed.

In an embodiment, a right and left vertical cross member 222 form the right and left sides of the pan compartment 244, the right edge cross member 170 and the left edge cross member 172 lie on top of at least half of a width of the vertical cross members and an area of reveal is provided by the underside of the right edge cross member and the left edge cross member.

In an embodiment, the pan compartment 144, 244 includes a floor piece 124 forming a bottom side of the pan compartment 144, 244 the floor piece includes a spring tab 118 that presses on a bottom of the pan 114 and pushes the pan against either the frame 116 or the lid 150.

In an embodiment, the composition includes pressed powder.

In an embodiment, the base 104 includes an upper border 112 around an opening, and an upper side of the frame 116 or lid 150 is adjacent the underside of the upper border.

In an embodiment, the pan 114 is a six-sided thin walled structure with a top being open.

In an embodiment, the top edges of the pan 114 press against the underside of the frame 116 or lid 150.

While illustrative embodiments have been illustrated and described, it will be appreciated that various changes can be made therein without departing from the spirit and scope of the invention.

The embodiments of the invention in which an exclusive property or privilege is claimed are defined as follows:

1. A palette, comprising:

a base enclosing a drawer;

the drawer includes a plurality of pan compartments and a plurality of pans, wherein each pan of the plurality of pans is within a pan compartment, and each pan holds a composition, and the drawer can slide in and out from the base;

each pan is retained in a pan compartment by an application of a force that presses on a bottom of each pan, and a top of each pan presses against a frame or lid connected on top of the drawer;

each pan is removable from a pan compartment when the drawer is slid out from the base to expose an opening in a pan compartment through which a pan is removed from the drawer; and wherein each pan compartment includes a floor piece forming a bottom side of each pan compartment, the floor piece includes a spring tab that presses on a bottom of the pan and pushes the pan against either the frame or the lid, wherein the spring tab is a thinned three-sided section of the floor piece.

2. The palette of claim 1, wherein the base is a six-sided structure with an opening on one side to allow the drawer to slide in and out.

3. The palette of claim 1, wherein each pan compartment is a six-sided structure wherein at least the front of each pan compartment is open to allow a pan to slide in and out from each pan compartment.

4. The palette of claim 1, wherein the drawer includes a frame fixed to a top side of the drawer, wherein the frame cannot swing open.

5. The palette of claim 4, wherein the frame includes two opposite long stringers connected to each other by cross stringers, and the frame has an opening for each pan compartment.

6. The palette of claim 5, wherein a right and left vertical cross member form right and left sides of at least one pan compartment, the cross stringers lie on top of the vertical cross members and an area of reveal is provided by the underside of the cross stringers.

7. The palette of claim 1, wherein the drawer includes one or more pan compartment lid connected to the drawer via one or more hinge, the one or more pan compartment lid can swing open to allow one or more pan to be removed from the top of the drawer.

8. The palette of claim 7, wherein the one or more pan compartment lid includes a left edge cross member, a right edge cross member, a front member, and a back member forming at least one opening through which a pan is accessed when the lid is closed.

9. The palette of claim 8, wherein a right and left vertical cross member form the right and left sides of at least one pan compartment, the right edge cross member and the left edge cross member lie on top of at least half of a width of the vertical cross members and an area of reveal is provided by the underside of the right edge cross member and the left edge cross member.

10. The palette of claim 1, wherein the composition includes pressed powder.

11. The palette of claim 1, wherein the base includes an upper border around an opening, and an upper side of the frame or lid is adjacent the underside of the upper border.

12. The palette of claim 1, wherein each pan is a six-sided thin walled structure with a top being open.

13. The palette of claim 12, wherein top edges of each pan press against the underside of the frame or lid.

* * * * *